United States Patent [19]

Sartore

[11] 3,997,966

[45] Dec. 21, 1976

[54] COMBINATION NAIL CLIPPER, CLIPPING RECEPTACLE AND REMOVABLE FRONT LID

[76] Inventor: James J. A. Sartore, 128 Morris St., Albany, N.Y. 12208

[22] Filed: May 24, 1976

[21] Appl. No.: 689,536

[52] U.S. Cl. ..... 30/28

[51] Int. Cl.[2] ..... A45D 29/02

[58] Field of Search ..... 30/124, 28, 29; 132/73

[56] References Cited

UNITED STATES PATENTS

| | | | |
|---|---|---|---|
| 2,887,773 | 5/1959 | Killen | 30/28 |
| 3,031,754 | 5/1962 | Pocoski | 30/28 |
| 3,180,025 | 4/1965 | Tsunemi | 30/28 |
| 3,316,632 | 5/1967 | Bowers | 30/28 |
| 3,855,698 | 12/1974 | Crosby | 30/124 |
| 3,943,948 | 3/1976 | Sartore | 30/28 X |

*Primary Examiner*—Al Lawrence Smith
*Assistant Examiner*—J. C. Peters

[57] ABSTRACT

An improved nail clipper which contains upper and lower handles to facilitate holding the unit and maintaining it in the desired position. Comprising cutting jaws in three sides to allow nail clipping from different and more convenient angles. Also a clipping receptacle with removable lid which surrounds the unit and holds the clippings produced, therein.

13 Claims, 2 Drawing Figures

COMBINATION NAIL CLIPPER, CLIPPING RECEPTACLE AND REMOVABLE FRONT LID

BACKGROUND OF THE INVENTION

This invention relates generally to nail clippers with receptacles and a front lid and in particular to a new and improved nail clipper which contains cutting jaws on three sides to obtain the desired clipping angle, having handles for convenience and to maintain a more secure grip on the unit. Also included is a removable front lid to hold waste clippings, therein.

A case with closeable lid for a nail clip is disclosed and claimed in U.S. Pat. No. 3,943,948 issued Mar. 16, 1976 to the inventor of the present invention.

Some problems and limitations which this invention solves are:

First, the clipper can now be placed at different desired angles for clipping the nails.

Secondly, the upper and lower handles make holding the nail clipper easier and more secure.

Thirdly, the clipping receptacle with removable front lid will prevent unwanted waste clippings from being dispersed in the surrounding environment.

Fourthly, the removable front lid can fit between the cutting jaws, engage the nail clipper operating arm rivet to allow the front lid to be held in position and effectively cover the cutting jaws.

Other uses and benefits will become apparent during this disclosure.

SUMMARY OF THE INVENTION

This invention is a new improved nail clipper with clipping receptacle and removable front lid which can be made of any material desired. However, the nail clipper members, operating arm rivet, and operating arm should preferably be made from a hard resilient material such as spring steel.

The nail clipper is comprised of cutting jaws on three sides of its opposite end, whose movement is controlled by an operating arm which is attached to an operating arm rivet passing through aligned openings in the nail clipper members.

Handles placed at the end of the nail clipper members (the end opposite the cutting jaws) and at the end of the operating arm (end which does not contain the operating arm rivet) provide a secure hold for the fingers of the operator.

The clipping receptacle surrounds the nail clipper members preventing escape of waste clippings and the front closeable lid completes the enclosure.

The principle objective of this invention is to provide upper and lower handles to allow the nail clipper to be held more securely and conveniently during the nail clipping operation.

Secondly, side cutting jaws are included to allow the nail clipper to be placed at a more natural and convenient angle in respect to the nail, when the clipping operation is being carried out.

Thirdly, the nail clipper is provided with a clipping receptacle and removable front lid to hold nail clippings which would otherwise be randomly and haphazardly be dispersed into the surrounding environment.

These and other advantages of the invention will become apparent after a study of the drawing and after reviewing the written specification describing the preferred embodiment. Like numerals are employed to designate like parts throughout same.

DESCRIPTION OF THE PREFERRED EMBODIMENT

Figure 1:
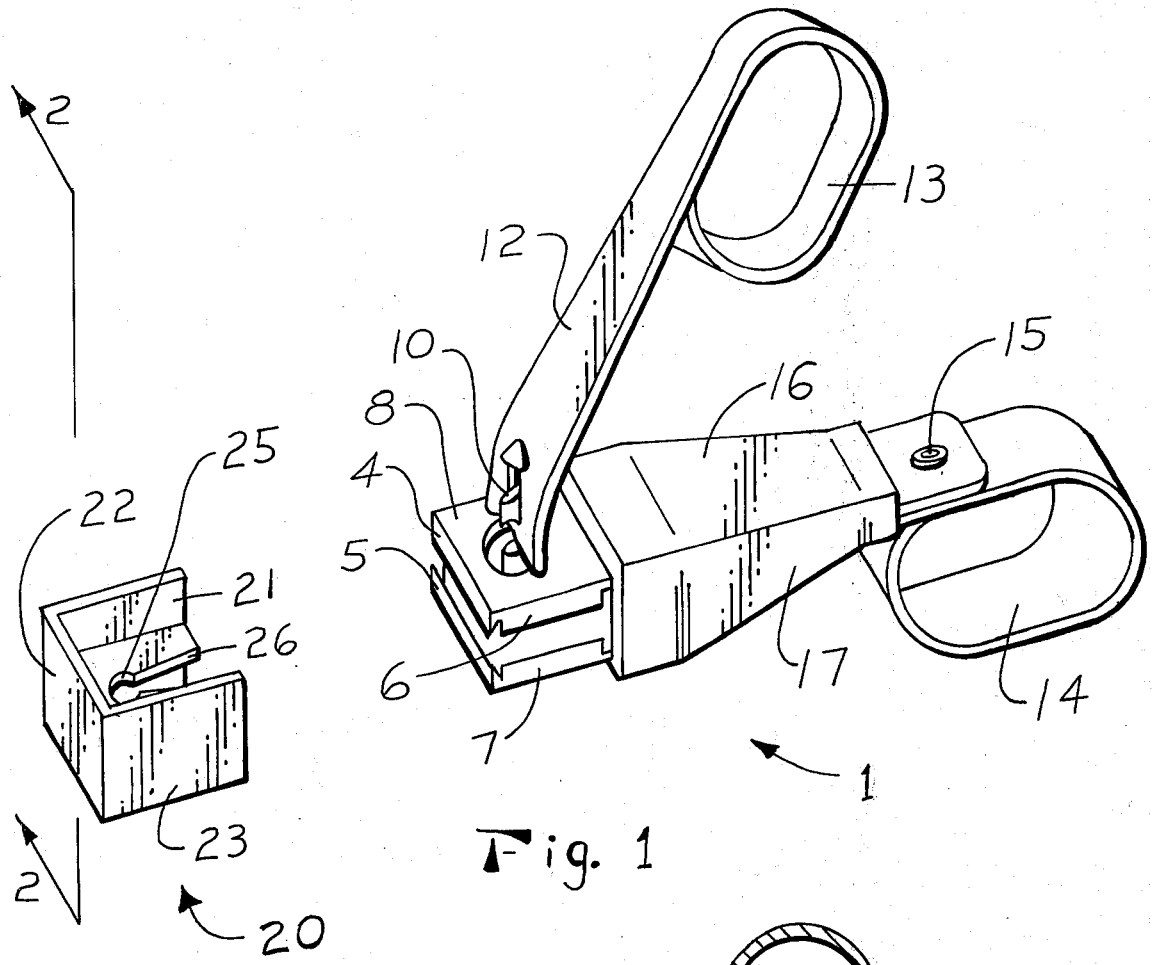
FIG. 1 is an isometric view of the new improved nail clipper, clipping receptacle and removable front lid.

Referring to the drawing in general and particularly to FIG. 1 of the drawing, is shown the new improved nail clipper with a clipping receptacle depicted generally by the numeral 1 and a removable front lid shown generally by the numeral 20. The nail clipping receptacle and removable front lid can be formed of plastic or any other material desired. However, the nail clipper parts must be formed of a hard material and or resilient material, such as, spring steel or any material exhibiting such qualities.

Figure 2:
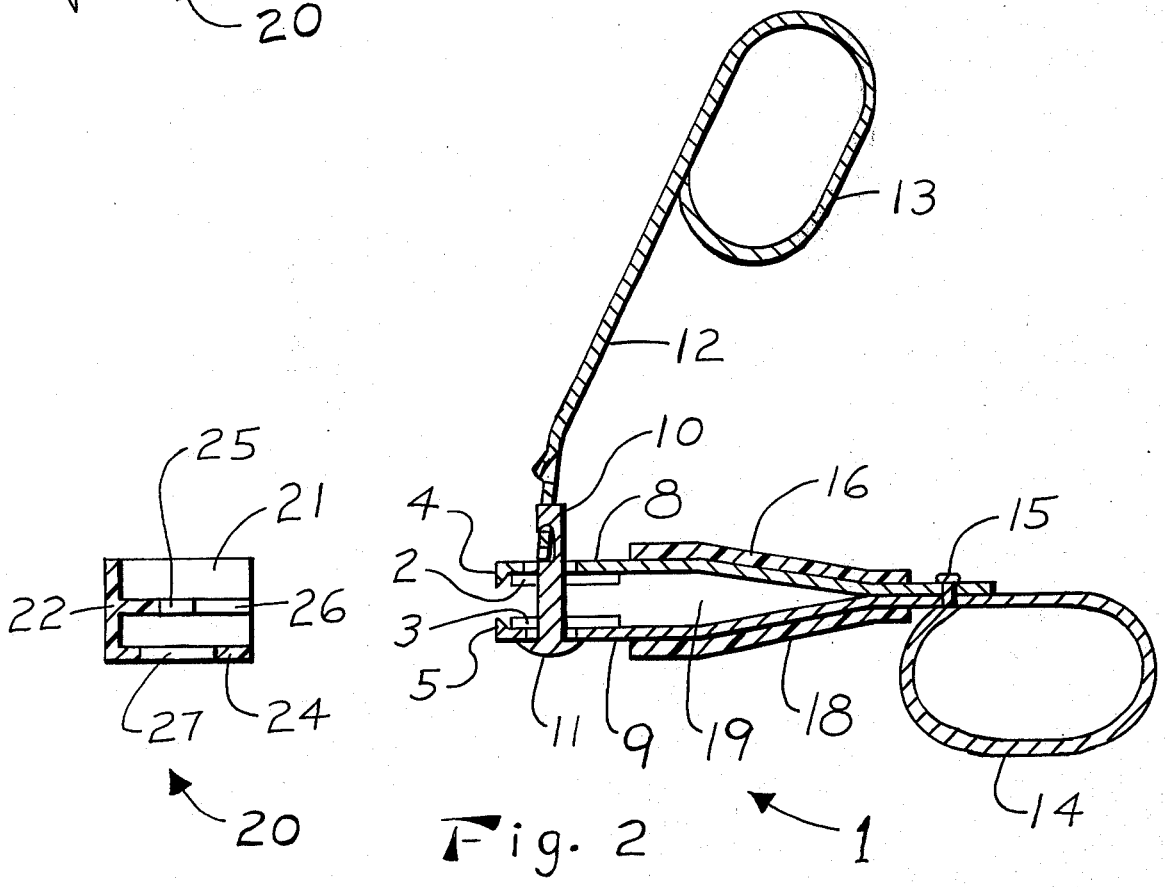
FIG. 2 is a cross sectional view of the improved nail clipper, clipping receptacle and removable front lid taken along lines 2—2 of FIG. 1.

The clipping receptacle 16–19 and or the removable front lid 20 may each be constructed in a one-piece configuration as can be seen from FIGS. 1 and 2 or may be constructed in more than one piece by providing manufactured joints where required.

The nail clipper may be constructed of strong resilient parts, such as, from spring steel, fastened and or combined as shown in FIGS. 1 and 2 of the drawing.

The nail clipper is comprised of upper nail clip member 8 and lower nail clip member 9 fastened at their one end by means of rivet 15 and or manufactured joints. At this same end and formed from the lower nail clip member 9 is a lower formed handle 14, see FIGS. 1 and 2.

The opposite end contains front cutting jaws 4 and 5, left cutting jaws 2 and 3 and right cutting jaws 6 and 7. They will allow the nail clipper and receptacle 1 to be held at a more convenient angle to facilitate the nail clipping operation. Also at this opposite end are placed two aligned openings through which is passed an operating arm rivet 10, attached to an operating arm 12 having an upper formed handle 13 at its end, see FIGS. 1 and 2.

The upper and lower formed handles 13 and 14 are so located that when in the non cutting or stored position, the formed handles 13 and 14 can be aligned to utilize the minimum amount of space possible. When in the cutting position, the operating arm 12 and the nail clipper members 8 and 9 with the clipping receptacle 16 through 19 will assume diverged position. Grasping the formed handles 13 and 14 will secure the fingers and hand hold on the nail clipper with clipping receptacle 1. Then manipulating action of the fingers using the formed handles 13 and 14 will be transmitted from the operating arm 12 to a raised portion on the operating arm which makes contact with the upper nail clip member 8 and will, in turn, result in the movement of the end containing the cutting jaws 2–7, see FIG. 2.

The nail clipping receptacle 16–19 contains top wall 16, bottom wall 18, and two side walls 17 and 19 in continuous relationship with each other with an opening running through the longitudinal portion and surrounding the nail clipper members 8 and 9. It is held in a fixed position by formed handle 14 acting as a stop. It then functions to contain waste clippings therein, see FIGS. 1 and 2.

A removable front lid 20 is also provided to complete the enclosure along with the clipping receptacle 16–19.

The removable front lid 20 is provided with a lid front wall 22 and two lid side walls 21 and 23 in continuous relationship surrounding the cutting jaws 2–7 with slotted insert 26 to fit between them and operating arm rivet catch opening 25 to hold the removable front lid 20 in place. Lid bottom 24 contains a bottom operating arm rivet opening 27 to mate with the bottom of operating arm rivet 11 to form an additional catch. This completes the enclosure, see FIGS. 1 and 2.

It is to be understood that the aforementioned invention shown and described is to be taken as a preferred example of the same and that various changes relative to material, size, shape and arangement of parts may be resorted to without departing from the spirit of the invention and the subjoined claims.

What I claim is:

1. A nail clipper surrounded by a receptacle containing a front lid which can contain waste clippings produced, said nail clipper being generally comprised of upper and lower nail clipper members fastened at one end forming a bifurcated portion, whose opposite end contains front jaws spaced apart formed in opposing relationship to each other, tied together by means of an operating arm rivet and operating arm, said operating arm rivet being placed through aligned openings located near said front jaws controlling the movement of said jaws through said nail clipper members which are fastened at said one end;

wherein the improvement comprises, a generally tubular nail clipping receptacle portion formed of top, bottom and two side walls in continuous relationship with each other, surrounding that portion of the nail clipper members not containing cutting jaws;

one end of the nail clipper contains a lower formed handle with the upper and lower nail clipper members diverging out and abutting the respective said top and bottom clipping receptacle walls and having two said clipping receptacle side walls to complete the enclosure;

the nail clipper opposite end containing front, left and right said cutting jaws which are controlled by manipulating both the upper formed handle which is at the end of the operating arm and said lower formed handle which is at the end of the said nail clipper members when in the operating position;

a removable front lid is provided and is comprised of lid front wall and two lid side walls which when placed over the said nail clipper opposite end surround the said nail clipper cutting jaws and contains a slotted insert and operating arm rivet catch opening to fit between and block the opening formed by the said cutting jaws, said operating arm rivet catch opening as part of the said slotted insert unites with and holds the operating arm rivet which will maintain the said front lid in position, also an operating arm rivet opening works in conjunction with the said slotted insert and said operating arm rivet catch opening to hold the said removable front lid in this position until removal is desired.

2. Nail clipper with receptacle and removable front lid of claim 1 wherein the nail clipper receptacle may be made from either flexible or non flexible material.

3. Nail clipper with receptacle and removable front lid of claim 1 wherein the nail clipper opposite end contains cutting jaws which may be of any shape, configuration or size desired.

4. Nail clipper with receptacle and removable front lid of claim 1 wherein the removable front lid placed at the opposite end of the nail clipper can be shaped to fit the external portion of that nail clipper which it covers.

5. Nail clipper with receptacle and removable front lid of claim 1 wherein the nail clipper end and the operating arm end contain formed handles made of the same material or materials as the said nail clipper.

6. Nail clipper with receptacle and removable front lid of claim 2 wherein a nail clipper receptacle end abuts the lower nail clipper formed handle and is permanently held in place.

7. Nail clipper with receptacle and removable front lid of claim 3 wherein all the nail clipper cutting jaws contain the same size opening.

8. Nail clipper with receptacle and removable front lid of claim 5 wherein the formed handles of the nail clipper can have any shape, size or configuration desired.

9. Nail clipper with receptacle and removable front lid of claim 8 wherein the nail clipper lower and upper formed handles may be covered with plastic or any other material and shaped as desired.

10. A nail clipper surrounded by a receptacle containing a front lid which can contain waste clippings produced, said nail clipper being generally comprised of upper and lower nail clipper members fastened at one end forming a bifurcated portion, whose opposite end contains front jaws spaced apart formed in opposing relationship to each other, tied together by means of an operating arm rivet and operating arm, said operating arm rivet being placed through aligned openings located near said front jaws controlling the movement of said jaws through said nail clipper members which are fastened at said one end;

wherein the improvement comprises, a clipping receptacle formed to surround the nail clipper members which do not contain cutting jaws, being generally comprised of top, bottom and two side walls in continuous relationship with each other and whose end is comprised of a lower formed handle, forming a single unit which contains an internal portion to fit the said nail clipper members in glovelike fashion, once the said nail clipper is inserted therein, the upper and lower said nail clipper members abut the respective said top and bottom walls of the said clipping receptacle and having the said clipping receptacle side walls complete the enclosure, said internal portion containing a recess to accommodate a rivet and form a catch with it, holding the said combination in position;

the nail clipper opposite end contains left, right and front said cutting jaws which are controlled by manipulating both the upper formed handle, which is attached to the operating arm and the lower formed handle which is part of the said clipping receptacle, when they are in a diverged operating position;

a removable front lid is provided and is comprised of lid front wall and two lid side walls which when placed over the said nail clipper opposite end surround the said nail clipper cutting jaws and contains a slotted insert and operating arm rivet catch opening to fit between and block the opening formed by the said cutting jaws, said operating arm rivet catch opening as part of the said slotted insert unites with and holds the operating arm rivet which will maintain the said front lid in position, also an operating arm rivet opening works in conjunction with the said slotted insert and said operating arm rivet catch opening to hold the said removable front lid in this position until removal is desired;

the said operating arm containing a file or filing ridges placed along its longitudinal surface.

11. Nail clipper with receptacle and removable front lid of claim 10 wherein the clipping receptacle and or the nail clipper may contain or be made from magnetic material to hold it in position.

12. Nail clipper with receptacle and removable front lid of claim 10 wherein the rivet contains an opening and the clipping receptacle contains an opening which will align when the two are in proper position to pass a keeper and hold the combination together.

13. Nail clipper with receptacle and removable front lid of claim 10 wherein the upper formed handle being removable and containing a sleeve with the internal said sleeve portion shaped to fit the said upper handle in glovelike fashion where they make contact with the operating arm, having a catch or opening in each which will align to pass and hold a keeper therein, holding the combination in position.

* * * * *